United States Patent [19]

Stuart

[11] 4,070,227

[45] Jan. 24, 1978

[54] TAPING MACHINE FOR COILS AND THE LIKE

[75] Inventor: Donald J. Stuart, Park Ridge, Ill.

[73] Assignee: Midland Engineering and Machine Co., Rosemont, Ill.

[21] Appl. No.: 677,898

[22] Filed: Apr. 19, 1976

[51] Int. Cl.[2] ..... B32B 31/00

[52] U.S. Cl. ..... 156/446; 156/522

[58] Field of Search ..... 156/185, 351, 361, 388, 156/446, 458, 459, 475, 510, 567, 571; 242/7.08, 7.14

[56] References Cited

U.S. PATENT DOCUMENTS

| | | | |
|---|---|---|---|
| 1,832,501 | 11/1931 | Pittenger et al. | 156/388 |
| 3,017,313 | 1/1962 | Lagasse et al. | 156/446 |
| 3,362,863 | 1/1968 | Larsson et al. | 156/185 |
| 3,567,546 | 3/1971 | Morris et al. | 156/446 |
| 3,586,570 | 6/1971 | Solomon et al. | 156/458 |
| 3,778,321 | 12/1973 | Abbott | 156/458 |
| 3,901,757 | 8/1975 | Eglinton | 156/446 |
| 3,938,748 | 2/1976 | Camardella | 242/7.14 |
| 3,970,259 | 7/1976 | Schmid | 242/7.08 |

*Primary Examiner*—David A. Simmons

*Attorney, Agent, or Firm*—Leydig, Voit, Osann, Mayer & Holdt, Ltd.

[57] ABSTRACT

A machine for taping coils wound upon bobbins which includes an indexable turret wheel mounting a plurality of peripherally spaced mandrels dimensioned for slidable reception of the bobbins of a succession of coils, the turret traversing a loading station, a tape wrapping station, a wiping station and an unloading station. A tape applicator member at the wrapping station supports the leading end of the tape, the applicator being shiftable from a reference position to a pressing position in which the leading end of the tape is pressed against the side of the coil. Drive spindles are clutched to the mandrels in the wrapping and wiping stations for wrapping and wiping the tape. Fluid actuators having rack and pinion connections serve to index the turret wheel, shift the tape applicator, and rotate the coil in the wrapping and wiping stations. The phase position of each coil bobbin loaded on a mandrel in the loading station is preserved throughout the cycle to permit registered imprinting and the performance of other functions requiring accurate bobbin register.

14 Claims, 16 Drawing Figures

AUXILIARY STATION 52
LOADING STATION 51
WRAPPING STATION 53
WIPING STATION 54
IMPRINTING STATION 55
UNLOADING STATION 56
IMPRINTER MECH.

Fig. 3.
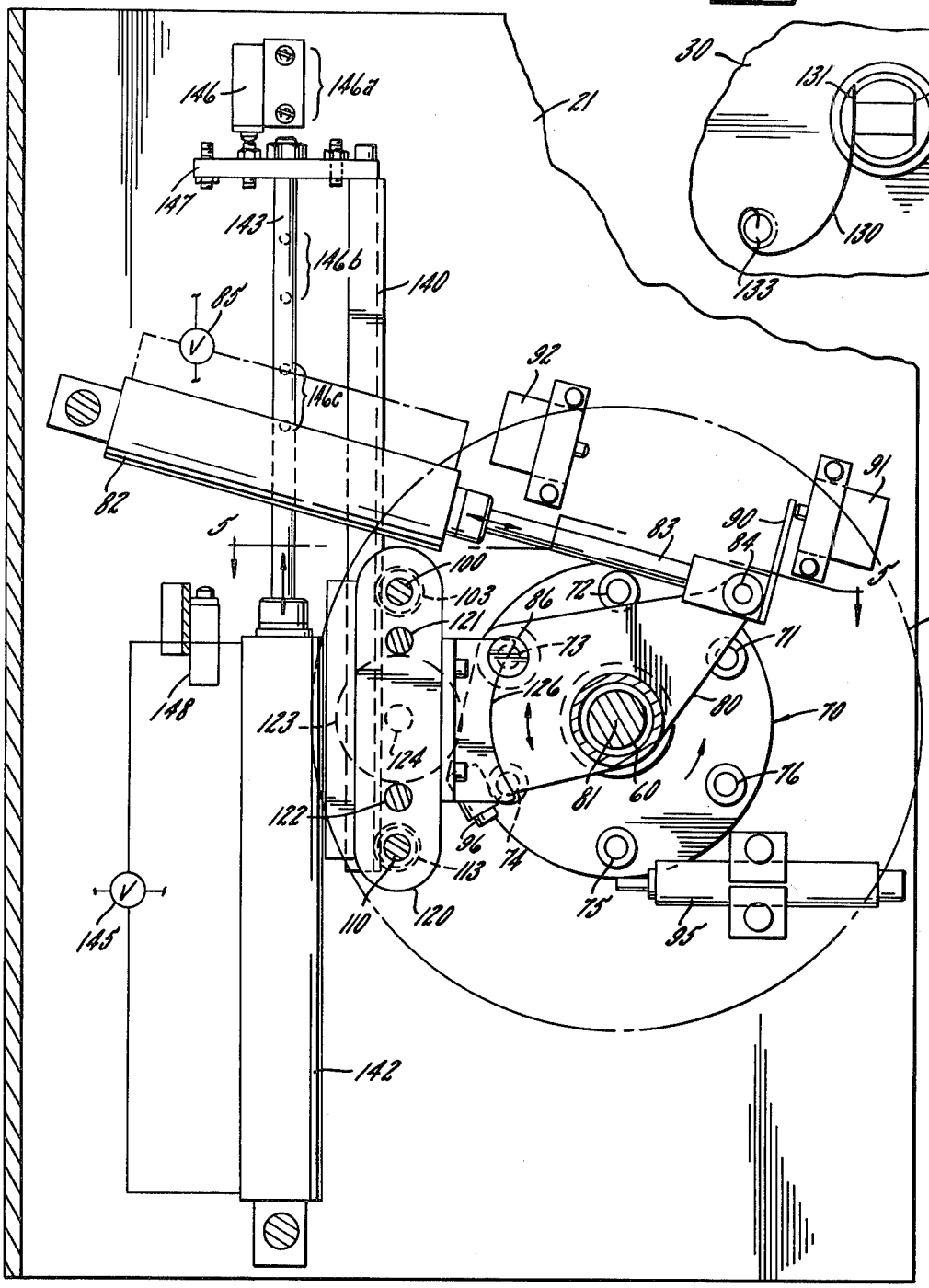
Fig. 8.
Fig. 13.
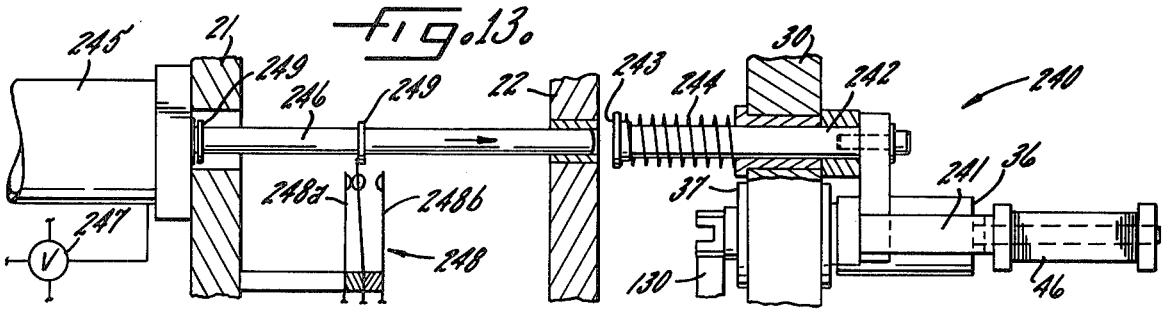

23
171
173
172
25
195
197
163
151
154
162
152
155
22
170
160
165
202
196
167
200
166
190
184
180
181
11
193
182
201
194
183
32
241
42
217
161
156
212
213
175
43
153
33
216
211
210
241
215
V
30
241
34
44
60

TAPING MACHINE FOR COILS AND THE LIKE

The taping of coils wound upon bobbins as required in the manufacture of relays, solenoids, transformers and the like has, in the past, been performed in two separate ways: For large production runs automated taping machines are commercially available for feeding large runs of coils from bulk storage and taping them at a high production rate. For shorter runs, where the expense of a completely automated taping machine cannot be justified, it has been the practice to employ hand operated machines in which a coil is manually loaded on a mandrel, wrapped and "wiped" under manual control, and manually unloaded. Such machines may be easily converted from one coil size to another as required for short runs, but since only one coil can be processed at a time production rates have been limited, as a practical matter, to approximately 1200 pieces per hour. The need has existed over the years for a machine having the advantages of a manually controlled machine, namely, low initial cost and rapid accommodation to different sizes of coils, but which is capable of production line usage.

It is, accordingly, an object to provide a taping machine which is of relatively simple and economical construction but which is capable of taping coils at a rate comparable to expensive fully automated taping machines. It is a related object to provide such a machine which is capable of performing functions simultaneously at a plurality of work stations and which is capable of operating in an automatic and continuous sequence with no care or attention on the part of the operator except to load the coils, one by one, on mandrels successively presented at a loading station.

It is a related object to provide a taping machine which is competitive with highly automated taping machines and which is inherently foolproof in operation and able to operate at a high production rate hour after hour, and day after day, without maintenance or adjustment.

It is another object of the present invention to provide a taping machine which is capable of being changed, in only a few minutes time, to accommodate coils of widely different shape and dimension. More specifically, it is an object of the invention to provide a taping machine including an applicator member having a pad thereon movable between a reference position and a pressing position for tacking the leading end of adhesive tape to the coil prior to wrapping of the tape and in which the pad follows an arcuate path which is adjustable in radius and shiftable in position. It is a more detailed object to provide an applicator assembly which is guided in its path of movement by a crank having both adjustable "throw" and adjustable spacing with respect to the applicator pad.

It is a further object of the invention to provide a taping machine which may be manually loaded, and supervised, with a high degree of safety and in which the hands of the operator are at all times safely clear of the rotatable elements and clear of the power operated cutting blade. It is a related object to provide a machine of the above type which is not only safe but which is easy to load on a continuous basis, all of the other steps, including unloading, being performed by the machine in predetermined automatic sequence.

It is another object of the invention to provide a taping machine which is highly versatile and which has provision for registered imprinting of identifying information following the wrapping and wiping of a coil but before the coil is discharged from the machine. It is a further object of the invention, in this connection, to provide a taping machine having a turret wheel having auxiliary stations permitting the addition of functions as, for example, the wrapping on of more than one type of tape and with the machine even being adaptable to the addition of a winding at a station interposed before or after the wrapping and wiping stations.

Other features and advantages of the invention will become apparent upon reading the attached detailed description and upon reference to the drawings in which FIG. 1 is an elevational view showing the front of a taping machine constructed in accordance with the present invention;

FIG. 3 is a vertical section taken along line 3—3 in FIG. 2 and showing the turret wheel indexing means at the beginning of an indexing stroke;

FIG. 8 is a fragment showing the detent construction for maintaining the phase positions of the mandrels and as viewed along line 8—8 in FIG. 7;

Figure 14:
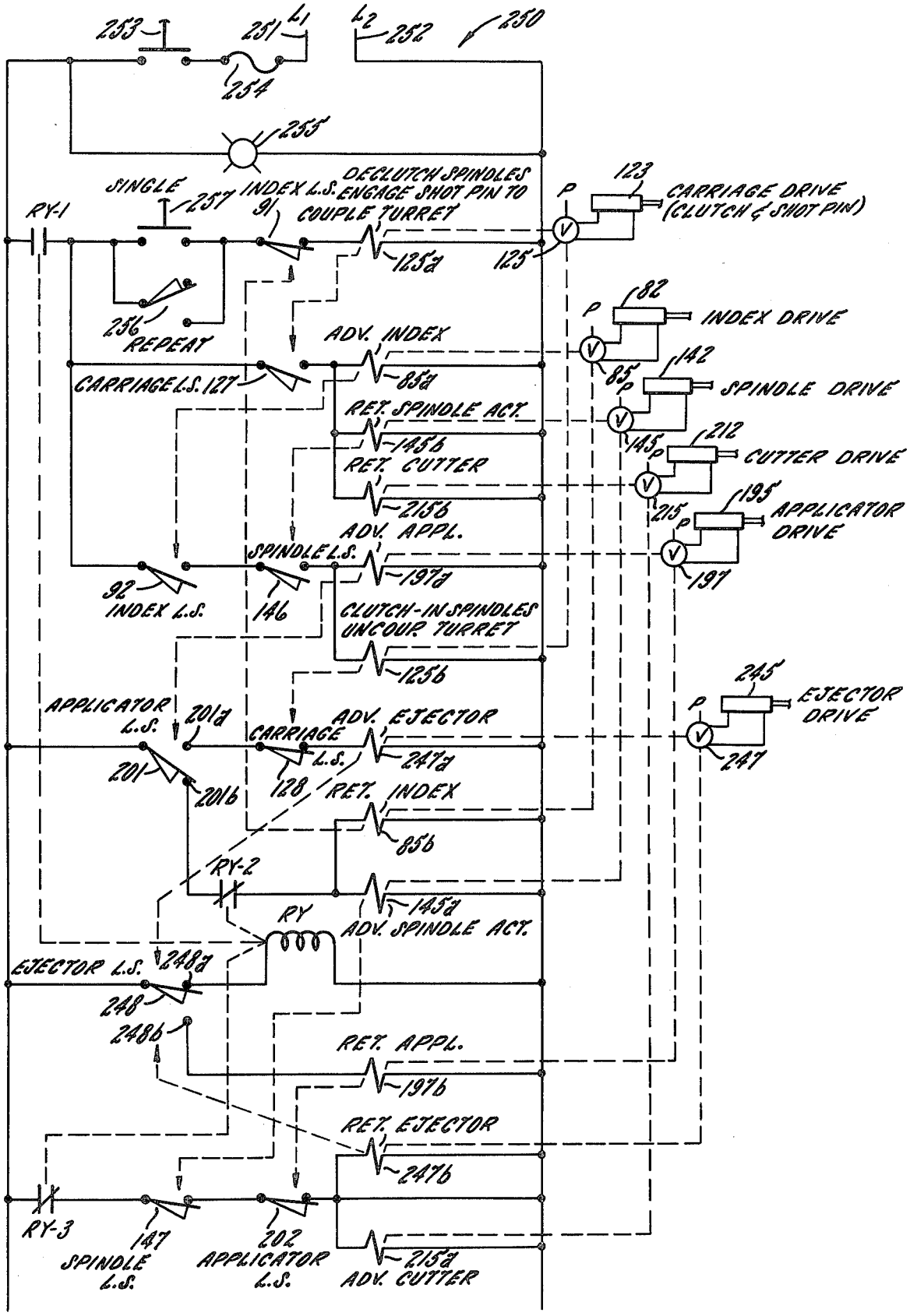

FIGS. **12*a*, 12*b* and 12*c*** are stop motion diagrams showing the path of shifting movement of the applicator pad;

FIG. 13 is a cross section taken through the ejector at the unloading station; and FIG. 14 is a schematic control diagram.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figure 1:
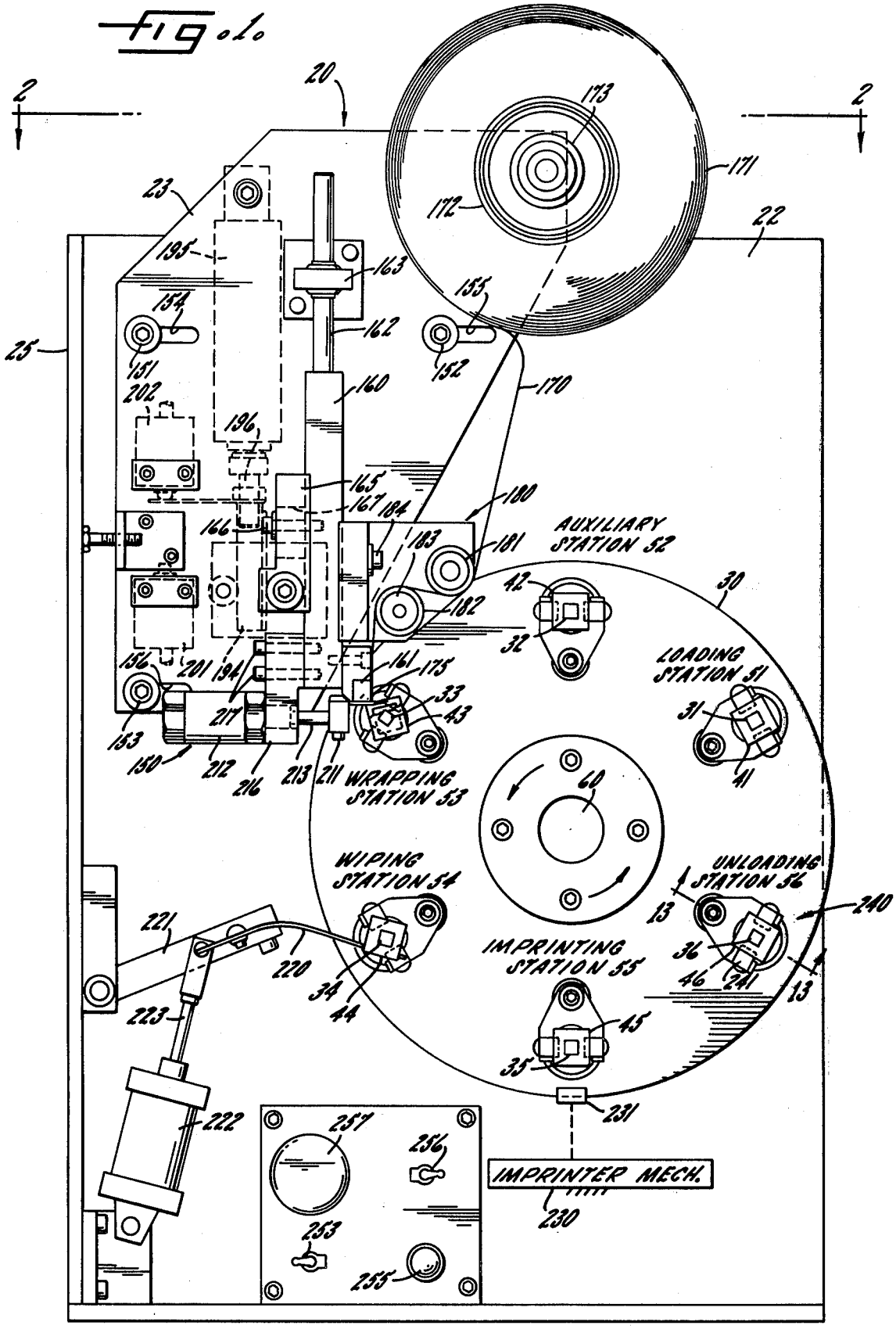
Figure 2:
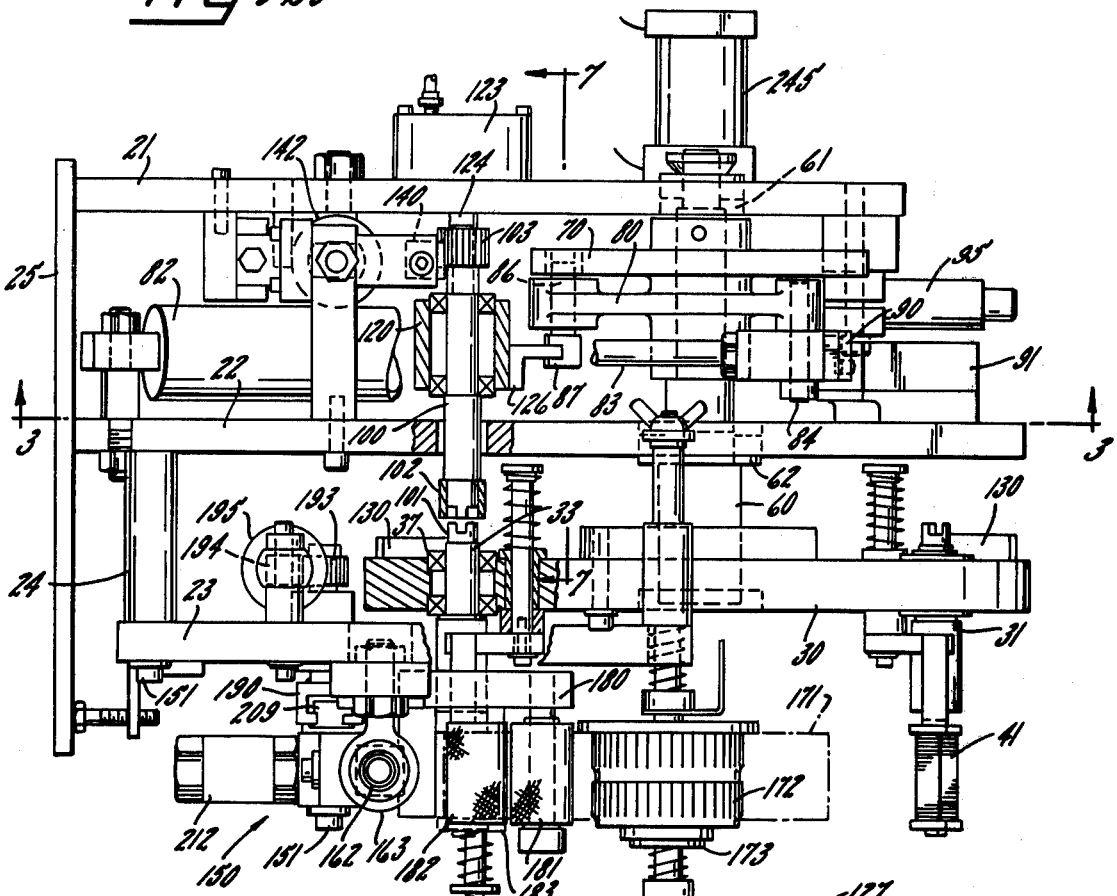
FIG. 2 is a top view looking along line 2—2 in FIG. 1.

Turning now to the drawings FIG. 1 shows a taping machine constructed in accordance with the invention having a frame generally indicated at 20 including upstanding main frame plates 21, 22 and an auxiliary front frame plate 23 which is parallel thereto and which is supported on posts such as that indicated at 24 in FIG. 2. The frame plates 21, 22 are joined at their left-hand edges by a vertical end plate 25.

Mounted for rotation about a horizontal axis is a turret wheel 30 having a set of mandrels, in the present case six of them indicated at 31–36 spaced at equal angles and journaled in bearings 37, the mandrels being all of the same size and dimensioned for slidable reception of the bobbins of coils to be taped, the coils supported on the mandrels being indicated at 41–46. As shown in FIG. 1, coils respectively occupy a loading station 51, an auxiliary station 52, a wrapping station 53, a wiping station 54, an imprinting station 55, and an unloading station 56.

Means are provided, as will be seen, for rotating the mandrels in the wrapping and wiping stations for wrapping on a layer of tape and for wiping down the tail end thereof, but the mandrels are detentedly fixed in position in all of the other stations for maintenance of a predetermined phase position. However, prior to discussing driving and detenting, attention may be given to the mounting and indexing of the turret wheel 30. The turret wheel is mounted upon a shaft 60 journaled in bearings 61, 62 in frame plates 21, 22. Secured to the shaft 60 is an index disc 70 having a series of shot pin openings 71–76 (FIG. 3) spaced at equal angles about the periphery and corresponding to the positions of the mandrels 31–36. For the purpose of indexing the index wheel 70 and its connected turret wheel, an oscillated indexing lever 80 is provided which is coaxially pivoted for rocking movement about the wheel axis 81. The indexing lever 80 is oscillated by a double-acting fluid actuator 82 having a piston rod 83 having a pin type connection 84 with the lever. The extension and retraction of the piston rod is under control of a four way valve 85 to be discussed. To achieve one-way indexing, a disengageable shot pin connection is interposed between the lever 80 and the pin receiving openings in the index wheel 70, the shot pin being indicated at 86 having a slotted head 87, the pin being snugly fitted in an opening 88 in the lever (see FIGS. 5 and 6). For sensing the position of the piston rod 83 of the indexing actuator 82, a small bracket 90 (FIG. 1) is provided at the end of the piston rod alternatively engageable with index limit switches 91, 92. For cushioning the indexing movement a shock absorber 95 is mounted on the frame in the path of movement of a bumper 96 mounted at one end of the indexing lever 80.

Figure 4:
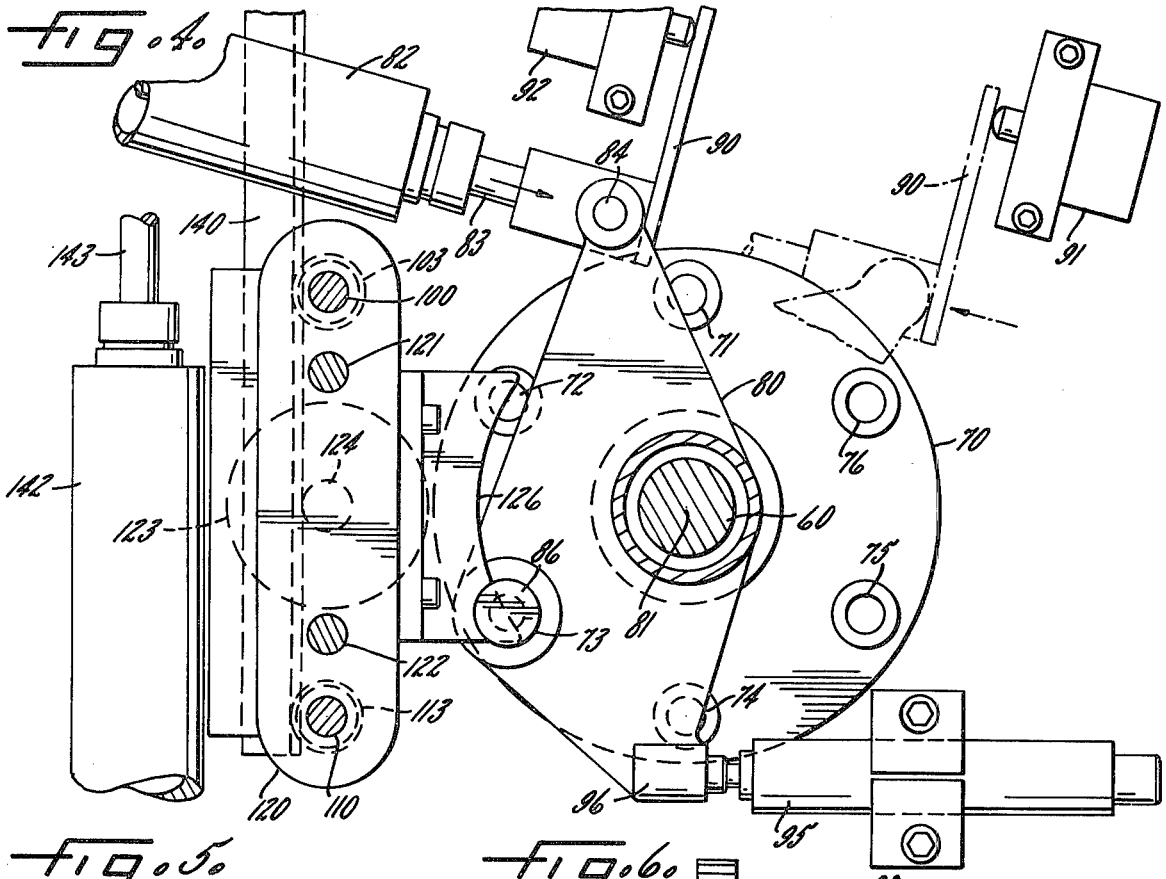
FIG. 4 shows an enlarged portion of FIG. 3 with the indexing means at the end of an indexing stroke.

In a typical cycle of indexing movement the shot pin 86 is inserted into one of the pin receiving openings, for example the opening 73 (see FIG. 5), following which the actuator 82 is contracted, rocking the indexing lever 80 in the counterclockwise direction, from the position shown in FIG. 3 to the position shown in FIG. 4, causing the turret wheel to be advanced counterclockwise through one step of movement. Upon retraction of the shot pin 86 from the opening in the index wheel (to be described), the indexing actuator 82 may be extended back into the position shown in FIG. 3 in an idle stroke of movement. It will be apparent that by engaging the shot pin only during the contraction strokes of the actuator, while disengaging the shot pin on the extension strokes, the turret wheel may be indexed in successive counterclockwise steps, thereby carrying coils from the loading station 51 through the processing steps and around to the unloading station 56 where ejection takes place.

Reference will next be made to the means for clutching and driving the mandrels in the wrapping and wiping stations. Referring to FIGS. 3–7 and most particularly to FIG. 7, the mandrel 33 in the wrapping station has, alined with it, a wrapping drive spindle 100. For clutching purposes dog-type clutch faces 101, 102 are formed on the mandrel and spindle, respectively, the spindle being driven by a pinion 103 at its opposite end. The mandrel 34 in the wiping station is driven by a wiping drive spindle 110 with similar clutch elements 111, 112 and a similar pinion 113. A "dog-type" clutch will be understood to include any clutch capable of positive driving.

The two drive spindles are both journaled in a "drive head" or carriage 120. The spindle carriage is mounted for limited axial movement on a pair of parallel way bars 121, 122 which are slideable in ways formed in the frame plates 21, 22. For axially moving the spindle carriage 120 a fluid actuator 123 is provided having a piston rod 124, the actuator being of the "pancake" type under the control of a four-way valve 125.

Figure 5:
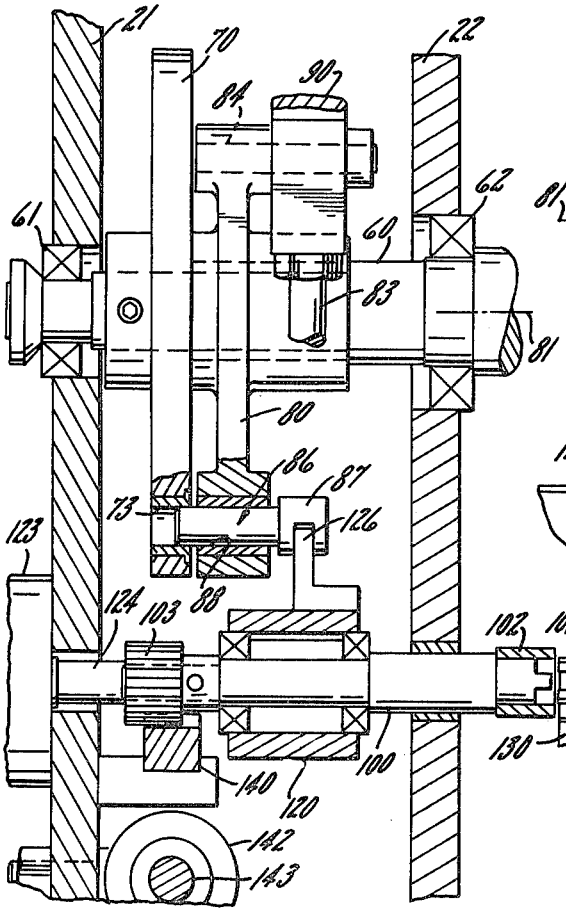
FIG. 5 is a fragmentary section looking along line 5—5 in FIG. 3 showing the visible drive spindle in disengaged condition.
Figure 6:
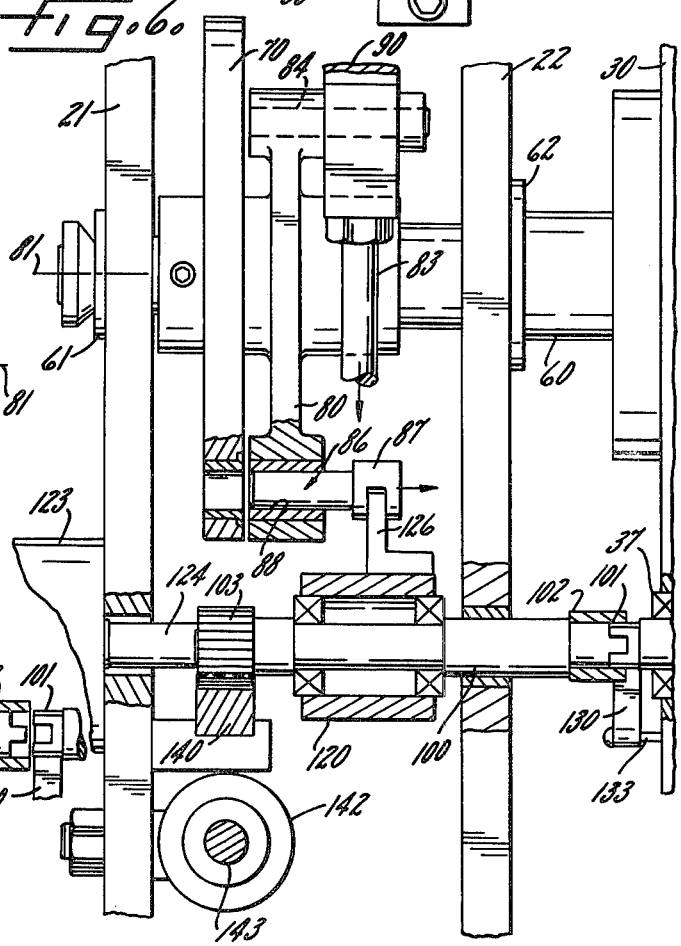
FIG. 6 is a view similar to FIG. 5 but showing the drive spindle engaged and the associated shot pin disengaged.

In accordance with one of the aspects of the present invention the spindle carriage 120 which controls the spindle clutches is also utilized to control the position of the shot pin 86, the shot pin being engaged when the clutches are disengaged and vice versa. The carriage is coupled to the shot pin by a key in the form of a concavely arcuate fin 126 which engages the slotted head 87 of the pin as shown in FIGS. 4, 5 and 6. The arcuate edge of the fin is centered on the turret wheel axis so that the shot pin is captive with the carriage at all times, in spite of the oscillating movement of the indexing lever 80. When the clutches are disengaged, the shot pin 86 is engaged as shown in FIG. 5—and vice versa as illustrated in FIG. 6. Limit switches 127, 128 (FIG. 7) are provided for signaling to the control circuit the respective "in" and "out" positions of the shot pin, as will be described in connection with the control circuit.

For the purpose of preserving the phase position of each of the mandrels, while enabling the mandrel to be rotated when the clutch associated with the mandrel is engaged, each mandrel is provided, adjacent its clutch surfaces, with a leaf spring 130 (FIG. 8) cooperating with flats 131, 132 formed on the portion of the mandrel which extends behind the turret wheel, the leaf spring being anchored to the turret wheel upon a post 133. The leaf spring has a degree of axial freedom so that when the clutch element on the associated drive spindle approaches, the end of the drive spindle engages the edge of the leaf spring thereby forcing it temporarily off of the flatted portion of the mandrel to permit the mandrel to be freely rotated; however, when the spindel is subsequently retracted the resiliency of the spring restores it to its initial detenting position.

In accordance with one of the aspects of the invention means are provided for driving the pinions 103, 113 on the drive spindles simultaneously and notwithstanding the endwise shifting of the drive spindles by the spindle carriage. Such driving is brought about by engaging both the pinions with a rack 140 which is reciprocated by a spindle actuator 142 having a piston rod 143, the actuator being controlled by a four-way valve 145. A limit switch 146 is positioned in the path of movement of a dog 147 at the end of the piston rod and rack to signal, to the control system, return of the spindle actuator to its illustrated (FIG. 3) reference position. A similar limit switch 148, placed in the path of opposite movement of the dog 147, signals, by its closure, the fact that the spindle actuator has been fully moved to its advanced position, that is, to the end of its driving stroke. The position of the switch 146 determines the number of "wraps". Three settings are possible, the positions indicated at 146*a, b* and *c*, giving 3, 2 and 1 wraps respectively.

In summary, then, engagement of the shot pin 86 and disengagement of the spindle clutches, by the carriage actuator 123 enables the turret wheel to be indexed forwardly through one step of movement, moving each of the mandrels into the next station where the drive spindles 100,110 are aligned with respective newly-arrived mandrels. Reversing the condition of the actuator 123 causes the spindle clutches to be engaged and the shot pin to be disengaged, for driving of the spindles by the rack 140 and its actuator 142 and return movement of the indexing lever 80 by means of its actuator 82 to reference position.

Having understood the means for indexing the turret wheel and for driving the mandrels in the wrapping and wiping stations, attention may now be given to the tape applicator assembly illustrated in FIGS. 1 and 2 and in greater detail in FIGS. 9–12. The applicator assembly, indicated generally at 150, is mounted upon the auxiliary frame plate, or subframe, 23. The subframe is adjustably secured to the vertical frame plate 22 by means of clamping screws 151–153 which engage the spacer posts 24 and which penetrate clearance slots 154–156 as will be further discussed. The tape applicator assembly 150, which is mounted for relative movement with respect to the subframe 23 and forwardly of the latter, includes a tape applicator member 160 which extends vertically along the subframe, having a resilient applicator pad 161 at its lower end and having its upper end 162 slidably received in a pivot connection 163. The applicator 160 is of two-part construction formed, in the present instance, by a vertical member of substantially square cross section, to which is secured, on its left-hand side, a bracket 165 which is clamped to the bar by means of the clamping screw 166 which penetrates a clearance slot 167 formed in the bracket.

Prior to discussing the means for shifting the applicator member, reference may be made to the tape supply. The tape 170 which is permanently tacky on its "inside" (or right-facing) surface is fed from a roll 171 mounted upon a mandrel 171 having a friction brake 173. The tape has a leading end 175 which terminates in a position flatly adjacent the face of the applicator pad 161. For the purpose of controlling and guiding the tape, it passes through a non-retrograde roller assembly 180 made up of a pair of rollers 181, 182 which are both mounted upon a bracket 183 which is clamped to the applicator member 160 by a clamping screw 184. The roller 181, which engages the non-tacky "back side" of the tape, is of non-retrograde construction being freely movable in the clockwise or feeding direction of the tape but being locked against any movement in the retrograde or counterclockwise direction. Non-retrograde rollers are per se well known in the art and do no require detailed description. The roller 182, which engages the tacky side of the tape, is an idler roller having a knurled surface and an adjustable brake 183. The rollers are laterally offset from one another so that the tape 170 undergoes an S-shaped, zig-zag, path thereby providing a "wrap" of the tape of at least 90° about each of the rollers, with the discharge side of the idler roller being substantially alined with and closely spaced to the applicator pad 161. By spacing the idler roller at a "low" position close to the applicator pad, there is minimum "springback" of the tape when it is subsequently severed under tension, as will be described. Thus the leading end 175 of the tape is always in proper registered position to be applied to the side of a coil.

In accordance with one of the aspects of the invention the applicator member 160 is guided so that the applicator pad thereon follows an arcuate path of movement from a reference position above a coil at the wrapping station to a pressing position at the side of the coil. This is accomplished by providing a crank, as a guiding element, which is rotatable upon a shaft and which has a pivot output connection engaging the applicator member 160 or, more specifically, engaging the bracket 165 which is adjustably clamped to the side of the applicator member. Referring to FIGS. 9, 10, 11 and 12 the crank indicated at 190, is secured to a crank shaft 191 which is journaled in a set of bearings 192 in the subframe 23. The crank shaft 192 terminates at its inner end at a pinion 193 which is rotated by a rack 194. The rack is positioned by an applicator actuator 195 having a piston rod 196, the actuator being under the control of a four-way valve 197. For signaling the position of the applicator to the control circuit, the piston 196 of the actuator is fitted with a switch operating dog 200 which engages limit switches 201, 202 at advanced and retracted positions of the applicator, respectively. To secure adjustability of throw in the crank 190, the crank is of key-slotted construction having a longitudinal recess 205 which has a relatively narrow access slot 206. The crank output connection is a pivot in the form of a screw 207 which is freely fitted in an opening 208 in the bracket 165. The screw passes through the access slot 206 into threaded engagement with a jam nut 209 which spans the recess.

Figure 12A:
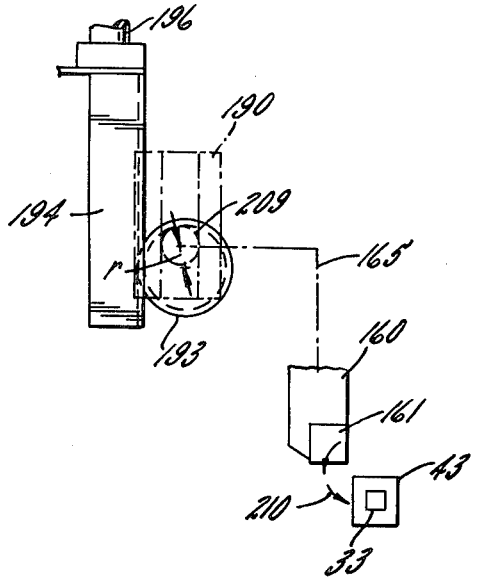
Figure 12B:
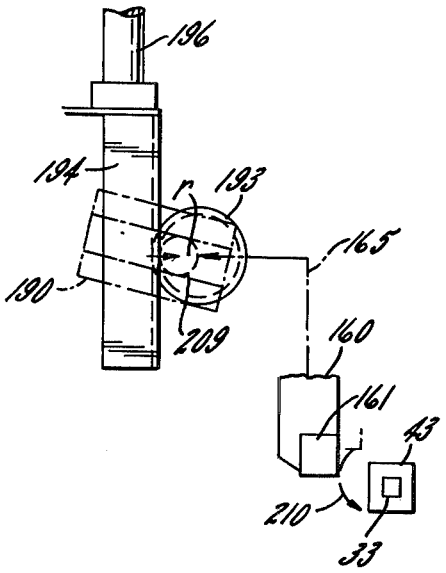
Figure 12C:
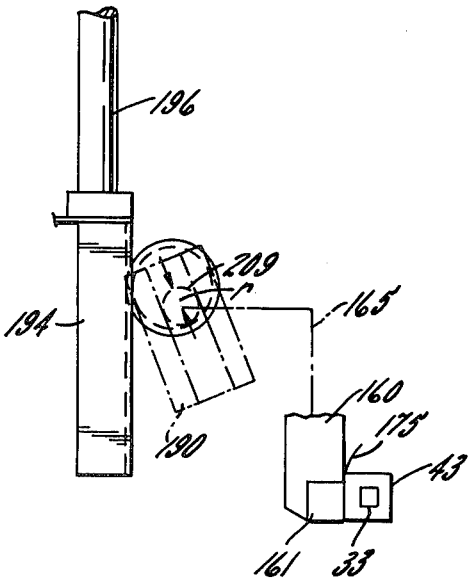

To adjust the throw of the crank and hence the radius of the arc of movement of the applicator pad, the screw 207 is unscrewed slightly, leaving the nut 209 loose in the recess 205, permitting the applicator member 160 to be moved bodily until the screw 207 occupies a position, with respect to the crank 190, which will provide the desired amount of throw. The screw is then turned tight until the tip of the screw bottoms in the recess 205, jamming the nut 209 in the opposite direction, thereby firmly anchoring the tip portion of the screw at a desired throw radius *r* on the crank. The effect of the crank will be apparent upon considering FIGS. 12*a*, 12*b* and 12*c*. Initially the pad 161 of the applicator member 160 occupies the "upper" position shown in FIG. 12*a*, with the crank 190 in the vertical position illustrated in FIG. 9. When the actuator 195 is expanded, moving the rack 194 downwardly, the pinion 193 on the crank shaft rotates in the counterclockwise direction, swinging the crank 190 counterclockwise from its vertical position to the horizontal position illustrated in FIG. 12*b*. As a result the applicator pad 161 follows the arc 210. Upon continued movement of the actuator and continued counterclockwise swing of the crank slightly beyond the bottom dead center position (see also FIG. 10) the applicator pad 161 continues along its arcuate path into firm pressing engagement with the side of the coil 43 as illustrated in FIG. 12*c*. By increasing the amount of throw *r* the radius of the arc 210 can be increased, and by decreasing the throw the radius of the arc can be decreased, thereby providing a wide range of size of arc to accommodate coils in a wide range of diameter.

Not only is the size of the arc capable of adjustment (by repositioning the screw 207 with respect to the crank 190) but also the arc of given radius can be bodily shifted upwardly and downwardly and from side to side. Vertical shifting may be accomplished by loosening the clamping screw 166 slightly and shifting the bracket 165 relative to the applicator member 160, the shifting movement being accommodated by the slot 167. Horizontal shifting of the arc 201 may be obtained by loosening the clamping screws 151–153 which hold the subframe, the adjusting movement being accommodated by the horizontal slots 154–156.

Thus, briefly stated, the applicator pad 161 is shiftable downwardly, along an arc, into pressing engagement with the side of the coil to tack the leading end of the tape in place. Such downward shifting movement of the pad is accompanied by downward shifting of the non-retrograde roller assembly thereby "taking" a slight amount of tape from the roll which is mounted upon a fixed center. When the crank is subsequently restored to its initial, or reference, position the applicator pad 161 is out of the way of the coil 43 so that the mandrel 33 may be rotated, wrapping a length of tape about the coil which is directly proportional to the stroke of the actuator 142 which powers the wrapping rack 140.

Figure 9:
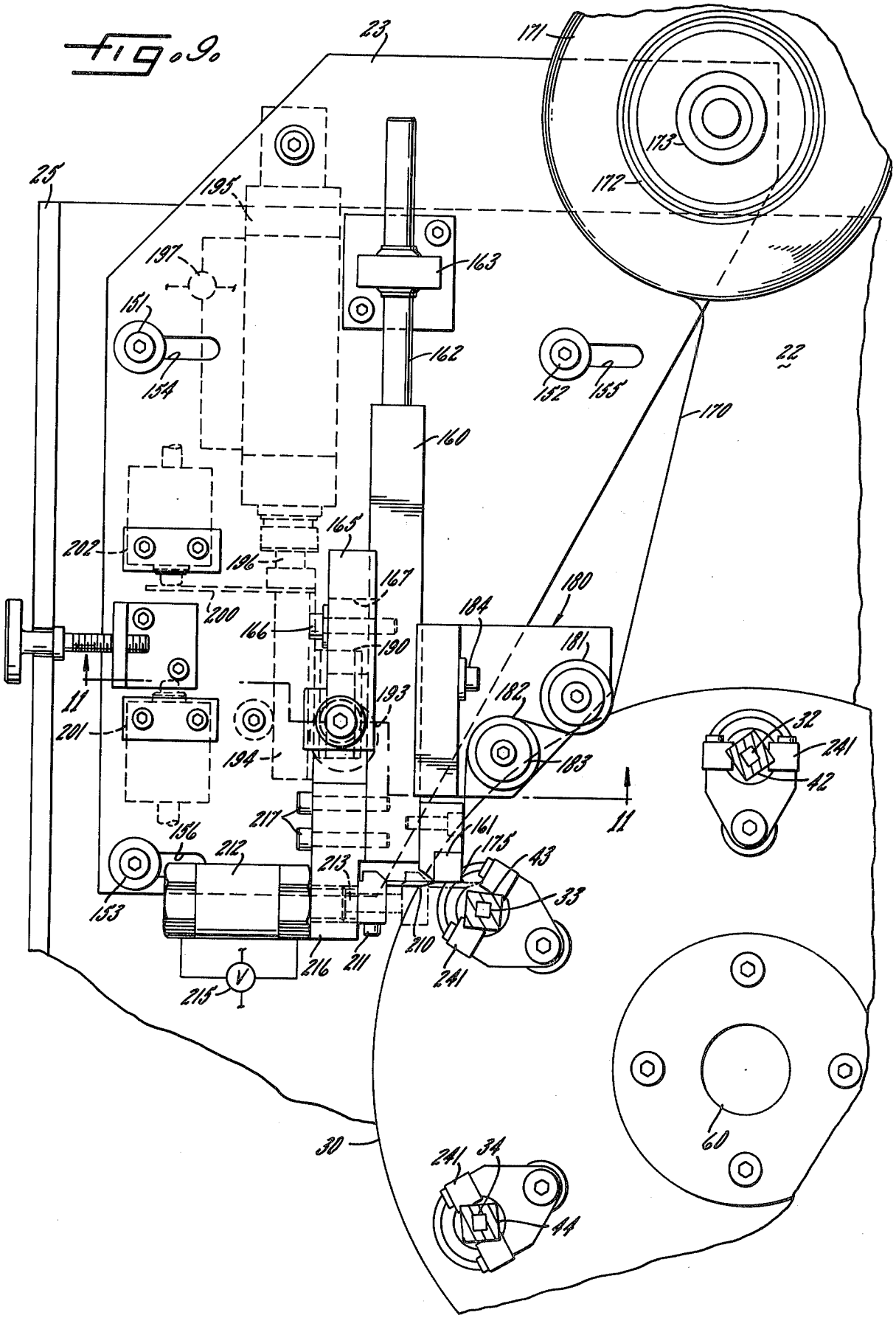
FIG. 9 is an enlarged view of the applicator assembly shown in FIG. 1.
Figure 10:
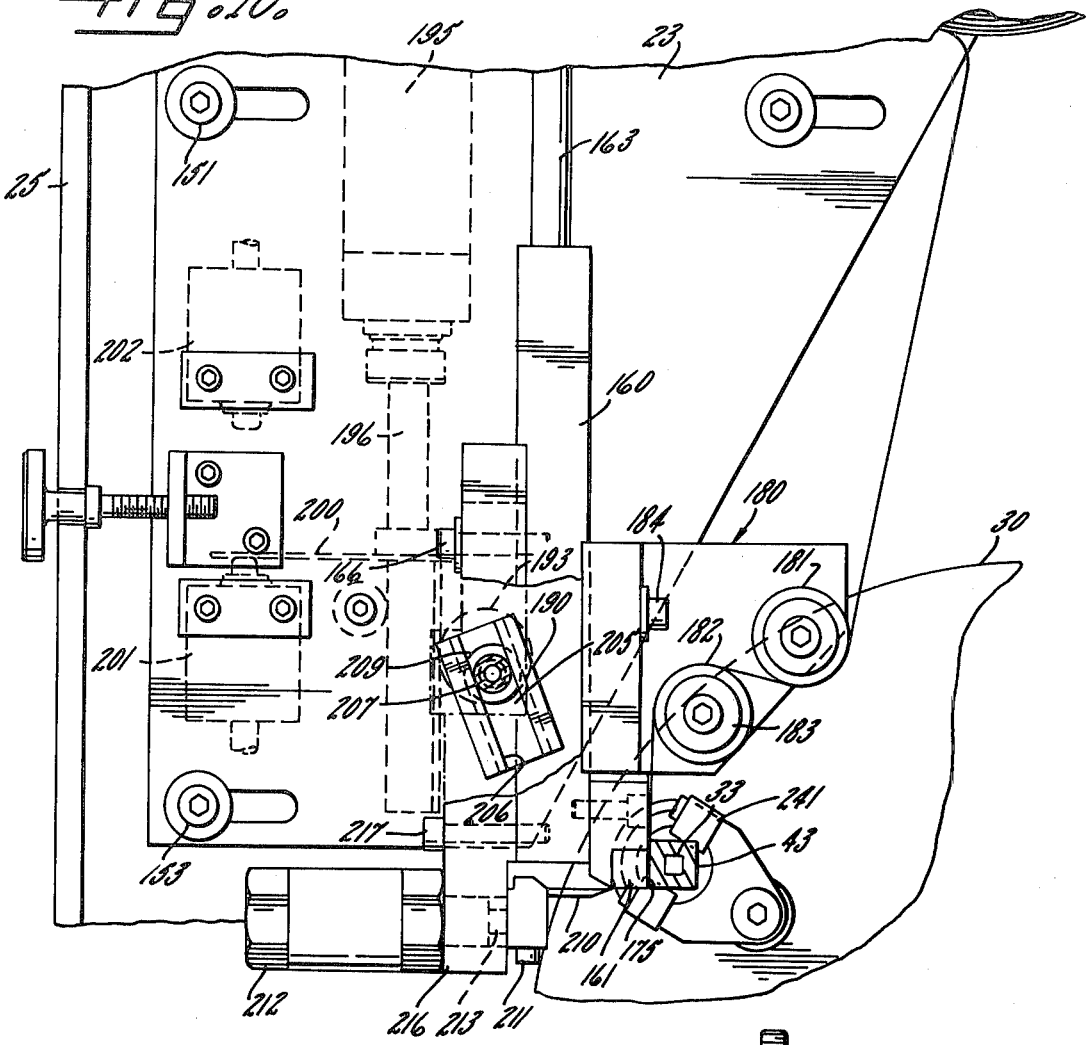
FIG. 10 is a fragmentary view similar to FIG. 9 but showing the tape applicator member in its pressing position.
Figure 11:
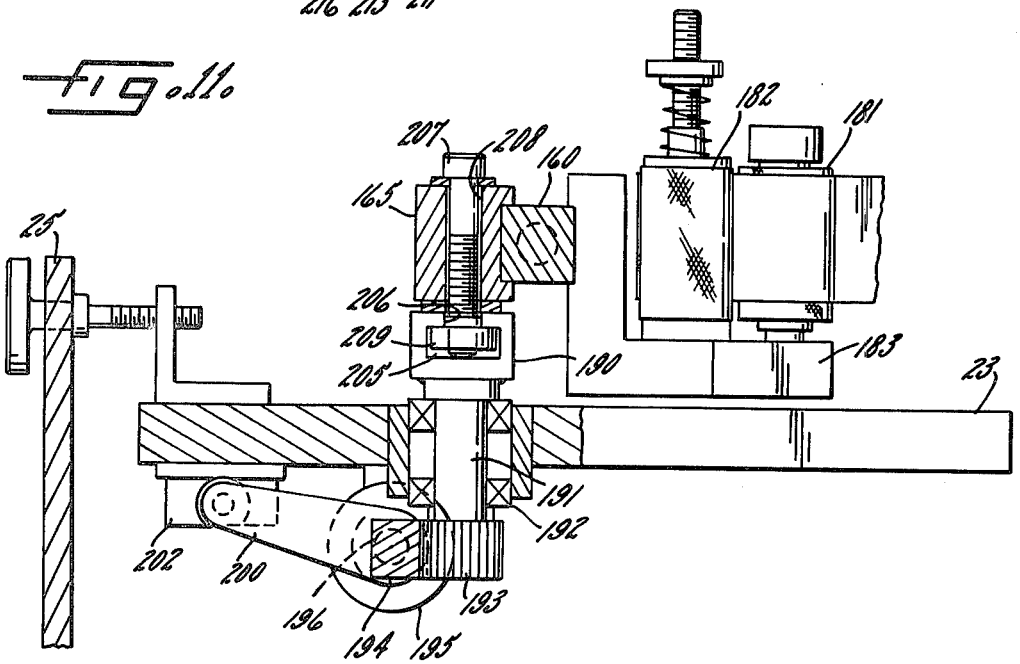
FIG. 11 is a fragmentary horizontal section looking along line 11—11 in FIG. 9.

In accordance with one of the features of the present invention, the tape wound about the coil is severed by a cutter blade which is positioned flatly along the underside of the applicator pad 161 and which is reciprocated by a cutter blade actuator. Referring to FIGS. 9 and 10, the cutter blade, indicated at 210 is secured to a mount 211 reciprocated by a cutter blade actuator 212 having a piston rod 213. The actuator is controlled by a four way valve 215. Conveniently, the actuator is secured to a bracket 216 which is clamped to the applicator member 160 by a pair of clamping screws 217. While the cutter blade 210 normally occupies a retracted position closely adjacent the underside of the applicator pad, extension of the actuator to the dotted position illustrated in FIG. 9 promptly severs the tape to form a trailing end and a new leading end. This completes the wrapping step and the coil is is next indexed to the wiping station where the trailing end of the tape is wiped down flatly against the coil.

Referring to the wiping station 54 in FIG. 1 there is provided a wiper in the form of a flexible blade 220 of nylon or the like mounted in a pivoted supporting arm 221 which is positioned by a wiper actuator 222 having a piston rod 223. It will be apparent that as the mandrel is rotated in the wiping station 54 by the wiper drive spindle 110, the wiper220 will, during the first revolution of the coil, smoothly wipe or "iron" the tail of the tape into a flat adherent position.

It is one of the features of the present invention that a bobbin is loaded at the loading station 51 in a position of register and that such register is maintained by reason of the detent springs 130. Angular movement from the detented position during spindle rotation is precisely predetermined, with the result that the bobbin occupies a predetermined registered position when it arrives at the imprinting station 55. In carrying out the invention an imprinter is provided in the imprinting station for printing or affixing identifying information. While the imprinter mechanism has been only diagrammatically shown at 230, it will be understood by one skilled in the art that the imprinter includes a movable printing head 231 which may be brought against the presented (lower) side of the coil occupying the imprinting station, reference being made to the prior art for imprinter details. It will be understood that the term "imprinter" as used herein is intended to cover not only printing means but any means for providing a printed message in a registered position as, for example, a label carrying printed identification thereon which may be simply stuck to the coil.

The coil, having been wrapped, wiped, and imprinted, then passes, by reason of a further step of indexing movement to the unloading station 56 where means are provided for automatic ejection of a coil from the mandrel upon which it is mounted. Such ejecting means is illustrated at 240 in FIG. 13. The ejecting means includes an ejecting finger, preferably a pair of ejecting fingers, 241, mounted upon a plunger 242 which penetrates the turret wheel, presenting an engageable face 243 at its inner end which is held in inwardly extended position by means of a coil spring 244. In register with the plunger 242 when the latter is in the unloading station is an ejector actuator 245 having a piston rod 245 and which is under the control of a four way valve 247. An outward thrust of the piston rod 246 engaging the face 243 of the plunger 242 thrusts the ejector fingers 241 to the right, pushing the coil 46 endwise from the mandrel upon which it has been mounted. For the purpose of sensing the return of the rejector to a retracted position a double throw type limit switch 248 is provided (FIG. 13) operated by dogs 249 which may, for example, be spaced on the piston rod 246 of the actuator.

CONTROL CIRCUIT

For achieving the sequence of operation outlined above, the valves and control elements may be wired in a control circuit as schematically set forth in FIG. 14. The circuit has power supply terminals 251, 252 and on-off supply switch 253, a fuse 254 and a pilot light 255. The circuit further includes a throw type switch 256 to initiate "repeat" automatic sequencing with a normally-open push button switch 257 in parallel therewith to be used where only a single cycle of operation is desired. The circuit includes a relay RY having a normally-open contact RY1 and two normally-closed contacts RY2, RY3.

In the illustrated circuit each valve which controls an actuator is operated by a pair of solenoids with each of the solenoids being effective in one direction, that is, the solenoids are effective to shift the valve into its respective states. The solenoids have been given the same reference numerals as the valves which they control, with addition of subscripts *a* and *b* to distinguish the solenoids which are in "control opposition" to one another.

Before the taping machine is placed into operation the following initial conditions exist The ejection plunger (FIG. 13) is in its returned (retracted) condition closing contact 248*a* and energizing relay RY to close contact RY1 while opening the normally closed contacts RY2 and RY3. The indexing actuator 82 (FIG. 3) is in its returned (extended) condition with limit switch 91 closed and limit switch 92 open. The cutter actuator 212 (FIG. 1) is in its advanced (extended) condition. Applicator actuator 192 (FIGS. 1 and 9) is in its returned (retracted) condition with contact 201*a* opened, 201*b* closed and contact 202 closed. The spindle actuator 142 is in its advanced (retracted) state with switch 146 opened and switch 148 closed. The carriage actuator 123 (FIG. 7) is in its advanced (extended) state with switch 127 open and switch 128 closed.

Figure 7:
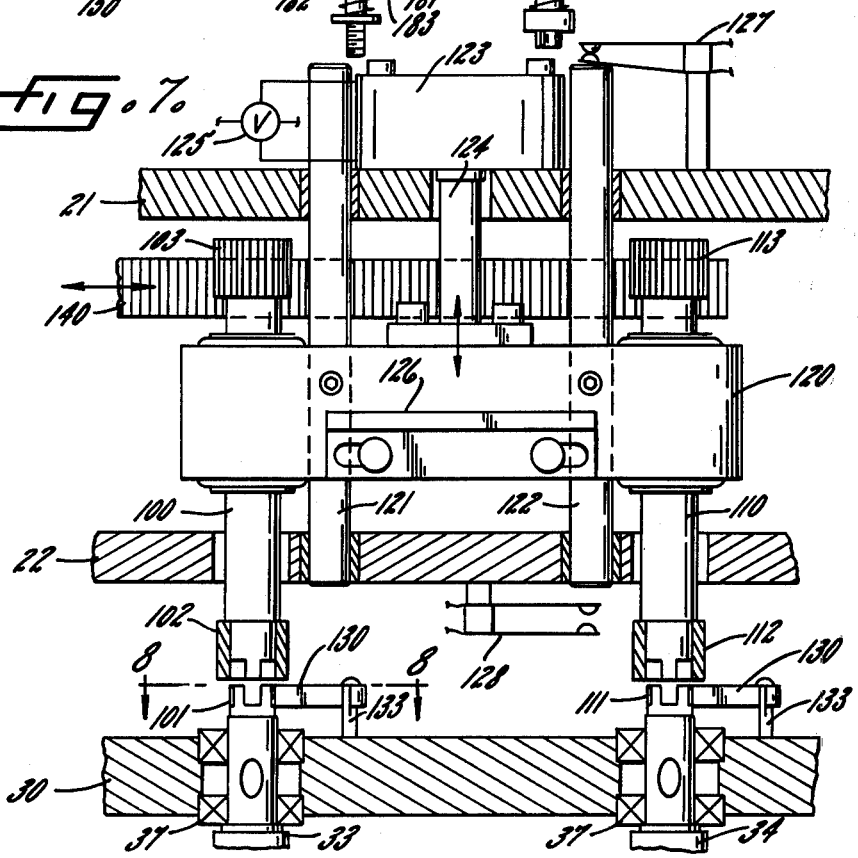
FIG. 7 is a fragmentary section looking along the lines 7—7 in FIG. 2.

Manually throwing the control switch 256 to its closed "auto" position completes the circuit through switch 91 to solenoid 125*a* to contract the actuator 123 and engage the shot pin 86 as shown in FIG. 5 in readiness for indexing while disengaging the drive spindles from the mandrels in the wrapping and wiping stations (see FIG. 7). This closes contact 127 and opens 128, energizing the solenoids 85*a*, 145*b* and 215*b*. Energizing the solenoid 85*a* operates the indexing actuator 82 closing limit switch 92 and opening limit switch 91. Energization of solenoid **215*b* retracts the cutter actuator 212. Energization of solenoid 145*b* returns the spindle actuator closing contact 146**.

Thus with the index stroke completed and the spindle actuator fully returned, the switches 92, 146, in series with one another are both closed thereby energizing solenoids **197*a* and 125*b*. Energization of solenoid 197*a* causes actuator 195 to be extended thereby rotating the crank 190 clockwise (FIGS. 12*a*–12*c*) and tacking the leading end 175 of the tape onto the side of the coil. As the actuator 195 begins to advance, contact 201*b* is opened but this makes no difference since contact RY2 is open in any event. Movement of the applicator actuator 195 to its fully advanced (extended) position closes contact 201*a* while energization of the solenoid 125*b* expands the actuator 123 to engage the clutches, thereby closing switch 128 which is in series with switch 201*a* and completing a circuit to solenoid 247*a*, causing extension of ejector actuator 245 and closure of the switch 248*b* (FIG. 13**).

As the ejector starts to advance, switch contact **248*a* opens dropping out the relay RY. This closes relay contact RY2 but this makes no difference since contact 201*b* is still open. As the ejector advances further, contact 248*b* is closed which energizes solenoid 197*b* to cause the applicator actuator to retract the applicator pad, its function now having been completed. As the applicator begins to return, contact 201*a* is broken which deenergizes the solenoid 247*a*, but this makes no difference since the ejector, by this time, has completed its advancing movement. Shortly thereafter contact 201*b* is made completing a circuit through contact RY2 (relay RY being in the dropped out state). This energizes solenoids 85*b* and 145*a*. Energization of solenoid 85*b* restores the index actuator to its initial, returned position. Energization of the solenoid 145*a* causes the wrapping actuator 142 to contract, thereby rotating the spindle 100 to wrap tape upon the coil. Upon completion of the spindle stroke and, upon return of the applicator actuator to its contracted position, switches 148, 202 are closed. Relay contact RY3 also being closed at this time (the relay RY having earlier dropped out), a circuit is completed to solenoids 247*b* and 215*a*. Energization of solenoid 215*a* advances the cutter blade to sever the tape, thereby restoring the cutter blade to its initial, extended position. Energization of solenoid 247*b* causes the ejector actuator to contract, thereby closing the rejector return switch 248*a* completing the circuit to the winding of relay RY. The energization of this relay establishes the initial condition, with relay contact RY1 closed to complete a circuit through the still closed control switch 256 and through the indexing limit switch 91 to energize the carriage solenoid 125*a* to set in motion a complete succeeding cycle, which then repeats itself indefinitely until the machine is turned off by opening the control switch 256**.

What is claimed is

1. In a taping machine for coils wound upon bobbins, the combination comprising a frame, a turret wheel mounted for rotation on the frame, the face of the wheel having mounted thereon a plurality of peripherally spaced mandrels dimensioned for slidable reception of the bobbins of a succession of coils, the turret having spaced about its periphery (a) a loading station where a coil is loaded on a mandrel, (b) a tape wrapping station, (c) a wiping station having a wiper for wiping down the tail of the tape, and (d) an unloading station, drive spindles located at the back of the turret wheel at the wrapping and wiping stations respectively, indexing means including an oscillating arm having a reciprocating actuator connected thereto for indexing the turret wheel to advance each mandrel into the next station, a tape applicator assembly at the wrapping station having an associated roll of adhesive tape and having a resilient applicator pad at the end thereof, the tape applicator assembly having non-retrograde roller means adjacent the applicator pad for supporting the leading end of the tape on the pad, the applicator member having means adjacent the applicator pad for guiding the pad along an arc of movement from a reference position in which the applicator pad is adjacent the coil to a pressing position in which the leading end of the tape is pressed by the applicator pad against the side of the coil to tack the tape to the coil followed by return of the applicator member to reference position, a pair of drive spindles at the wrapping and wiping stations, a shiftable carriage located behind the turret wheel for journalling the drive spindles, the drive spindles having pinions at one end and dog type clutch surfaces at the other, actuator means for shifting the carriage axially to bring the spindles into simultaneous clutching engagement with the mandrels at the respective wrapping and wiping stations, actuator means including a rack engaging the pinions so that upon a stroke of actuator movement the pinions are rotated through a predetermined number of revolutions for simultaneous wrapping and wiping of the tape on the coils in the wrapping and wiping stations, means including a cutter blade adajcent to the applicator pad for severing the tape following the wrapping thereof with the applicator member substantially in reference position to produce a new leading end positioned on the applicator pad.

2. The combination as claimed in claim 1 in which coil ejector means including an ejector actuator is provided at the unloading station and in which automatic sequencing means are provided for (a) advancing the indexing actuator to index the turret wheel to bring a loaded coil into the wrapping station, (b) advancing the applicator actuator to tack the leading end of the tape onto the coil, (c) advancing the ejector actuator to eject the coil in the unloading station, (d) reversely energizing the applicator actuator for return of the applicator to reference position (e) advancing the wrapper actuator for wrapping of tape on the coil, and (f) advancing the cutter actuator to sever the tape.

3. In a taping machine for coils wound upon bobbins, the combination comprising a frame, a turret wheel mounted for rotation on the frame, the face of the wheel having mounted thereon a plurality of peripherally spaced mandrels dimensioned for slidable reception of the bobbins of a succession of coils, the turret having spaced about its periphery a loading station where a coil is loaded on a mandrel as well as a tape wrapping station and an unloading station, a power drive spindle located at the back of the turrent wheel at the wrapping station, means for indexing the turret wheel to advance a loaded coil into the wrapping station, means on the frame for supporting a roll of adhesive tape, a tape applicator assembly at the wrapping station including a shiftable applicator member having non-retrograde roller means defining a run of tape and having a resilient applicator pad on the end thereof for supporting the leading end of the the tape, means for shifting the applicator member from a reference position in which the applicator pad is adjacent the coil to a pressing position in which the leading end of the tape is pressed by the applicator pad against the side of the coil to tack the tape to the coil accompanied by the drawing of tape from the roll and followed by return of the applicator member to reference position, means for temporarily clutching the drive spindle to the mandrel in the wrapping station, means for driving the drive spindle through a predetermined number of revolutions for wrapping of the tape on the coil, means including a cutter blade on the applicator assembly adjacent to the applicator pad for severing the tape with the applicator member substantially in reference position to produce a new leading end, and means for indexing the turret wheel to advance the taped coil to the unloading station for ejection from the mandrel, each of the mandrels having a resilient detent for maintaining the mandrel in a predetermined phase position between the loading station and the wrapping station and between the wrapping station and the unloading station, the detent being formed by a flat on the shaft of the mandrel resiliently engaged by a leaf spring and in which the leaf spring is in the path of movement of the drive spindle so that when the latter is clutched to the mandrel the leaf spring is pushed axially out of position thereby to temporarily disable the detent during the time that the drive spindle is engaged with the mandrel.

4. The combination as claimed in claim 1 in which an imprinting station is interposed between the wrapping station and the unloading station, the imprinting station having an imprinter secured to the frame for imprinting identifying information upon the presented side of the coil, each of the mandrels having a detent for maintaining the mandrel in a predetermined phase position both prior to and following the wrapping of tape so that when a bobbin is loaded onto the mandrel in predetermined phase position at the loading station the side of the coil which is imprinted at the imprinting station will always bear a predetermined phase relationship to the bobbin.

5. In a taping machine for coils wound upon bobbins, the combination comprising a frame, a turret wheel mounted for rotation on the frame, the face of the wheel having mounted thereon a plurality of peripherally spaced mandrels dimensioned for slidable reception of the bobbins of a succession of coils, the turret having spaced about its periphery a loading station where a coil is loaded on a mandrel as well as a tape wrapping station and an unloading station, a power drive spindle located at the back of the turret wheel at the wrapping station, means for indexing the turret wheel to advance a loaded coil into the wrapping station, means on the frame for supporting a roll of adhesive tape, a tape applicator assembly at the wrapping station including a shiftable applicator member having non-retrograde roller means defining a run of tape and having a resilient applicator pad on the end thereof for supporting the leading end of the tape, means for shifting the applicator member from a reference position in which the applicator pad is adjacent the coil to a pressing position in which the leading end of the tape is pressed by the applicator pad against the side of the coil to tack the tape to the coil accompanied by the drawing of tape from the roll and followed by return of the applicator member to reference position, means for temporarily clutching the drive spindle to the mandrel in the wrapping station, means for driving the drive spindle through a predetermined number of revolutions for wrapping of the tape on the coil, means including a cutter blade on the applicator assembly adjacent to the applicator pad for severing the tape with the applicator member substantially in reference position to produce a new leading end, and means for indexing the turret wheel to advance the taped coil to the unloading station for ejection from the mandrel, the drive spindle being connected to a drive pinion the driving means including a fluid actuator having a rack which engages the pinion, the drive spindle further having a dog type clutch connection with the mandrel, the drive spindle finally having means for moving the same endwise for engagement and disengagement of the dog type clutch connection and with the endwise movement being accommodated by axial slippage of the pinion on the rack.

6. In a taping machine for coils wound upon bobbins, the combination comprising a frame, a turret wheel mounted for rotation on the frame, the face of the wheel having mounted thereon a plurality of peripherally spaced mandrels dimensioned for slidable reception of the bobbins of a succession of coils, the turret having spaced about its periphery a loading station where a coil is loaded on a mandrel as well as a tape wrapping station and an unloading station, a power drive spindle located at the back of the turret wheel at the wrapping station, means for indexing the turret wheel to advance a loaded coil into the wrapping station, means on the frame for supporting a roll of adhesive tape, a tape applicator assembly at the wrapping station including a shiftable applicator member having non-retrograde roller means defining a run of tape and having a resilient applicator pad on the end thereof for supporting the leading end of the tape, means for shifting the applicator member from a reference position in which the applicator pad is adjacent the coil to a pressing position in which the leading end of the tape is pressed by the applicator pad against the side of the coil to tack the tape to the coil accompanied by the drawing of tape from the roll and followed by return of the applicator member to reference position, means for temporarily clutching the drive spindle to the mandrel in the wrapping station, means for driving the drive spindle through a predetermined number of revolutions for wrapping of the tape on the coil, means including a cutter blade on the applicator assembly adjacent to the applicator pad for severing the tape with the applicator member substantially in reference position to produce a new leading end, and means for indexing the turret wheel to advance the taped coil to the unloading station for ejection from the mandrel, an axially reciprocating carriage for journaling the drive spindle, means for moving the carriage for clutching and declutching the end of the drive spindle with respect to the mandrel, an indexing wheel coupled to the turret wheel and having a plurality of angularly spaced pin-receiving openings corresponding to the stations of the turret wheel, and a shot pin coupled for axial movement to the spindle carriage for entry into a presented opening as the carriage moves in one direction for immobilizing the turret wheel prior to engagement of the spindle with the mandrel upon movement of the carriage in its opposite direction.

7. In a taping machine for coils wound upon bobbins, the combination comprising a frame, a turret wheel mounted for rotation on the frame, the face of the wheel having mounted thereon a plurality of peripherally spaced mandrels dimensioned for slidable reception of the bobbins of a succession of coils, the turret having spaced about its periphery a loading station where a coil is loaded on a mandrel as well as a tape wrapping station and an unloading station, a power drive spindle located at the back of the turret wheel at the wrapping station, means for indexing the turret wheel to advance a loaded coil into the wrapping station, means on the frame for supporting a roll of adhesive tape, a tape applicator assembly at the wrapping station including a shiftable applicator member having non-retrograde roller means defining a run of tape and having a resilient applicator pad on the end thereof for supporting the leading end of the tape, means for shifting the applicator member from a reference position in which the applicator pad is adjacent the coil to a pressing position in which the leading end of the tape is pressed by the applicator pad against the side of the coil to tack the tape to the coil accompanied by the drawing of tape from the roll and followed by return of the applicator member to reference position, means for temporarily clutching the drive spindle to the mandrel in the wrapping station, means for driving the drive spindle through a predetermined number of revolutions for wrapping of the tape on the coil, means including a cutter blade on the applicator assembly adjacent to the applicator pad for severing the tape with the applicator member substantially in reference position to produce a new leading end, and means for indexing the turrent wheel to advance the taped coil to the unloading station for ejection from the mandrel, the indexing means including an oscillating lever coaxially pivoted at the backside of the turret and having a reference position and an advanced position, a fluid actuator coupled to the oscillating lever for oscillating the same, the oscillating lever having in register therewith an axially movable shot pin, the turret providing a circle of evenly spaced shot pin openings, a carriage for journaling the drive spindle, means for shifting the carriage for axial movement of the spindle in and out of clutching engagement with the mandrel in the wrapping station, the shot pin being keyed to the carriage for axial movement therewith so that when the drive spindle is moved to declutched position the shot pin is inserted into a presented opening so that when the actuator is energized the turret wheel is indexed forwardly through one step of movement and so that when the drive spindle is moved endwise into clutching position the shot pin is retracted thereby to permit return movement of the actuator and lever into reference position.

8. In a taping machine for coils wound upon bobbins, the combination comprising a frame, a turret wheel mounted for rotation on the frame, the face of the wheel having mounted thereon a plurality of peripherally spaced mandrels dimensioned for slideable reception of the bobbins of a succession of coils, the turret having spaced about its periphery (a) a loading station where a coil is loaded on a mandrel, (b) a tape wrapping station, (c) a wiping station having a wiper to wipe down the tail end of the tape, and (d) an unloading station, drive spindles located at the back of the turret wheel at the wrapping and wiping stations respectively, means for indexing the turret wheel to advance a loaded coil into the wrapping station, means on the frame for supporting a roll of adhesive tape, a tape applicator assembly at the wrapping station including a shiftable applicator member having secured to it non-retrograde roller means defining a run of tape and having a resilient applicator pad at the end thereof for supporting the leading end of the tape with sticky side out, means for shifting the applicator member from a reference position adjacent the coil to a pressing position in which the leading end of the tape is pressed by the applicator pad against the side of the coil to tack the tape to the coil accompanied by the drawing of tape from the roll and followed by return of the applicator member to reference position, means for temporarily clutching the wrapping drive spindle with the mandrel in the wrapping station, means for driving the wrapping drive spindle through a predetermined number of revolutions for wrapping of the tape on the coil, means including a cutter blade adjacent to the applicator pad for severing the tape with the applicator member substantially in reference position to produce a tail on the coil and a new leading end, means for indexing the turret wheel to advance the taped coil into the wiping station, means for temporarily clutching the wiping drive spindle with the mandrel supporting the coil, means for driving the wiping drive spindle so that the wiper wipes down the tail of the tape, means for indexing the turret wheel to advance the taped and wiped coil to the unloading station, means at the unloading station for ejecting the coil from the mandrel, the drive spindles being journaled in a common carriage, the carriage having means for axially shifting the same for simultaneous clutching of the drive spindles to the mandrels, the carriage having a common drive element connected to the spindles for simultaneous rotation thereof for simultaneous wrapping and wiping of coils at the respective stations.

9. The combination as claimed in claim 8 in which the common drive element connected to the spindles for simultaneous rotation thereof is a rack, a fluid actuator for reciprocating the rack, and means including adjustable limit stops for predetermining the stroke of the rack and accordingly the number of wraps of tape wound about the coil.

10. The combination as claimed in claim 8 in which the non-retrograde roller means defining the run of tape includes a non-retrograde roller engaging the backside of the tape and an idler roller having a knurled surface engaging the sticky side of the tape, the surface of the idler roller being located in general alignment with the applicator pad for discharge of the leading end of the tape substantially in the plane thereof, the rollers being spaced closely together and laterally offset from one another so that the run of tape is formed into an "S" configuration with an angle of wraparound about each of the rollers being at least on the order of 90°, the idler roller being located closely adjacent the applicator pad so that when the tape is cut by the blade there will be substantially zero springback of the tape even in the face of the winding tension developed therein.

11. The combination as claimed in claim 10 in which a bracket is provided for mounting the rollers on the applicator member the bracket being readily disengageable from the applicator member for facilitating substitution of a set of rollers of different width when taping coils on bobbins having different axial length.

12. The combination as claimed in claim 8 in which the means for shifting the applicator member includes a crank arm having an output connection coupled to the applicator member to cause the applicator pad to follow an arcuate path of movement between its reference and pressing positions, means for adjusting the spacing between the output connection and the pad for bodily shift of the arc of movement of the pad in a first direction, a subframe supported upon the frame adjacent the turret wheel, the tape applicator assembly being mounted upon the subframe, and means for adjusting the subframe upon the frame for bodily shift of the arc of movement of the pad in a second direction substantially at right angles to the first direction thereby to accommodate the applicator assembly to different coil diameters.

13. In a taping machine for coils wound upon bobbins, the combinatin comprising a frame, a turret wheel mounted for rotation on the frame, the face of the wheel having mounted thereon a plurality of peripherally spaced mandrels dimensioned for slideable reception of the bobbins of a succession of coils, the turret having spaced about its periphery (a) a loading station where a coil is loaded on the mandrel, (b) a tape wrapping station, (c) a wiping station having a wiper for wiping down the tail end of the tape, and (d) an unloading station, drive spindles located at the back of the turret wheel at the wrapping and wiping stations respectively, means for indexing the turret wheel to advance a coil into the wrapping station, means on the frame for supporting a role of adhesive tape, a tape applicator assembly including a shiftable applicator member having non-retrograde roller means defining a run of tape and having a resilient applicator pad on the end thereof for supporting the lead end of the tape, means for shifting the applicator member from a reference position to a position in which the leading end of the tape is pressed by the applicator pad against the side of the coil to tack the tape to the coil accompanied by the drawing of tape from the roll and followed by return to the reference position, means for temporarily clutching the wrapping drive spindle with thhe associated mandrel, means for driving the wrapping drive spindle through a predetermined number of revolutions for wrapping of the tape on the coil, means including a cutter blade adjacent to the applicator pad for severing the tape wear return of the applicator member substantially to reference position to produce a tail and a new leading end, means for indexing the turret wheel to advance the taped coil into the wiping station, means for temporarily clutching the wiping drive spindle with the mandrel supporting the taped coil, means for driving the wiping drive spindle so that the wiper wipes down the tail of the tape, means for indexing the turret wheel to advance the taped and wiped coil to the unloading station, means at the unloading station for ejecting the coil from the mandrel, the drive spindles being journaled in a common carriage, the carriage having means for axially shifting the same for simultaneous clutching of the drive spindles to the mandrels, the carriage having means including a common drive element connected to both of the spindles for simultaneous rotation thereof for simultaneous wrapping and wiping of coils at the respective stations.

14. In a taping machine for coils wound upon bobbins, the combination comprising a frame, a turret wheel mounted for rotation of the frame, the face of the wheel having mounted thereon a plurality of peripherally spaced mandrels dimensioned for slideable reception of the bobbins of a succession of coils, the turret having spaced about its periphery a loading station where a coil is loaded on a mandrel as well as a tape wrapping station and an unloading station, a drive spindle located at the back of the turret wheel at the wrapping station, means for indexing the turret wheel to advance a loaded coil into the wrapping station, the indexing means including an oscillating lever coaxially pivoted at the back side of the turret and having a reference position and an advanced position, a fluid actuator coupled to the oscillating lever for oscillating the same, the oscillating lever having in register therewith an axially movable shot pin, the turret providng a circle of evenly spaced shot pin openings registrable with the shot pin, a carriage for journaling the drive spindle, means for shifting the carriage for axial movement of the spindle in and out of clutching engagement with the mandrel in the wrapping station, the carriage having an arcuate key engaging the shot pin for axial movement of the shot pin by the carriage in all positions of the oscillating lever so that when the carriage moves the drive spindle to its declutched position it simultaneously inserts the shot pin into a presented opening in the turret wheel for indexing of the turret wheel and so that when the carriage moves the drive spindle into clutching position the shot pin is retracted thereby to permit return movement of the actuator and lever into reference position in readiness for a subsequent indexing step.

* * * * *